US007971311B2

(12) United States Patent
Zielinski

(10) Patent No.: US 7,971,311 B2
(45) Date of Patent: Jul. 5, 2011

(54) TRAVEL KIT AND ASSOCIATED METHOD

(76) Inventor: Robert S Zielinski, Bridgeview, IL (US)

( * ) Notice: Subject to any disclaimer, the term of this patent is extended or adjusted under 35 U.S.C. 154(b) by 1023 days.

(21) Appl. No.: 11/818,749

(22) Filed: Jun. 15, 2007

(65) Prior Publication Data

US 2008/0307595 A1 Dec. 18, 2008

(51) Int. Cl.
*A47K 7/00* (2006.01)

(52) U.S. Cl. ..... 15/144.4; 15/210.1; 15/244.1; 15/145

(58) Field of Classification Search ..... 15/144.4, 15/210.1, 244.1, 145
See application file for complete search history.

(56) References Cited

U.S. PATENT DOCUMENTS 3,407,424 A * 10/1968 Lanzarone et al. ..... 15/145
4,119,338 A * 10/1978 Agcaoili ..... 294/8.6
5,673,455 A 10/1997 Per-Lee et al.
6,438,787 B1 * 8/2002 Young ..... 15/210.1
D467,686 S 12/2002 Kohler
6,513,191 B1 * 2/2003 Kim ..... 15/414
6,808,185 B1 * 10/2004 Brace ..... 280/47.19
7,331,077 B1 * 2/2008 Henry ..... 15/23

* cited by examiner

*Primary Examiner* — Shay L Karls

(57) ABSTRACT

A travel kit for assisting a user to scratch, wash, and apply lotions to hard to reach areas of the body includes a hollow shaft provided with telescopically interfitted rectilinear first, second, and third sections respectively. The kit includes a rectilinear connector, and a plurality of attachments is connected directly to the connector and the distal tip of the third section. The travel kit further includes a mechanism for locking the hollow shaft between compressed and extended positions, a plurality of depressions, an arcuately shaped knob formed in the outer surface of the second and the third sections respectively, a plurality of cylindrical brackets directly attached to the outer surface of the first and second sections respectively, and a tab suitably shaped and sized to reside within an associated one of the outer depressions.

17 Claims, 7 Drawing Sheets

TRAVEL KIT AND ASSOCIATED METHOD

CROSS REFERENCE TO RELATED APPLICATIONS

This application claims the benefit of U.S. Provisional Application No. 60/804,006, filed Jun. 6, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to travel kits and, more particularly, to a travel kit and associated method for assisting a user to scratch, wash, and apply lotions to hard to reach areas of the body.

2. Prior Art

Most consumers recognize the importance of protecting the skin from the sun and strive to heed medical warnings by applying suntan lotion when enjoying the outdoors. As many consumers can attest, however, applying sun block to areas of the body such as the back or behind the shoulders and legs can be quite challenging without the help of a friend or companion. As a result, unprotected skin becomes highly susceptible to sun burn and other serious skin damage. Inadequate coverage can have aesthetic drawbacks as well. Those wishing to achieve a smooth, even tan often find that uneven application of lotions can instead result in blotchy tan lines and unsightly streaks. While those with sunbathing partners have someone to help them apply sunscreen, this is not an option for those sunbathing alone. Concerned with the health and look of their skin, consumers are often faced with the embarrassing prospect of soliciting help from a complete stranger.

U.S. Pat. No. 5,673,455 to Per-Lee discloses an applicator device for moving a contact surface against a person's back includes an elongated handle and a generally disc-shaped shell formed on one end of the handle. A generally disc-shaped cap is threadably engaged with the shell. The cap can be formed with structure for brushing, massaging, or scratching a person's back, or the cap can detachably hold one of a plurality of contact pads, with each contact pad having a structure and function distinct from the other pads. Unfortunately, this prior art example is not designed for traveling purposes.

U.S. Pat. No. 5,402,550 to Lessard discloses an arm extender, in accordance with the present invention, comprises a pair of spaced curved extending members which are joined at one end by a connecting member. Further, a bracket for mounting a sponge is pivotally attached to the connecting member. A sponge having an opening is disposed about the bracket and retained thereon by, for example, a Velcro® type attachment. A gripping member is connected between the extending members at a predetermined distance from the free end of the extending members. Also, a strap is provided near the free end of the extending members for securing the arm extender to a person's arm. The strap is secured to at least one of the extending members and wraps about the other extending member forming a loop therebetween whereupon the strap is attached onto itself. During use, the user grips the gripping member with the user's hand and the user's forearm is secured within the loop of the strap. The strap is attached by, for example, a Velcro® type attachment. The extending, gripping and connecting members are preferably comprised of a light weight plastic. Also, the gripping member and the portions of the extending members in contact with the user's forearm may be padded. Unfortunately, this prior art example is not designed for traveling purposes.

U.S. Pat. No. 6,438,787 to Young discloses a hand held back applicator for spreading emollients on one's back and other body parts, consisting of a curved handle with a grip, attached to a head with an absorbent pad accommodating the emollients. The pad is attached to the head by pressure-sensitive hook-and-loop strips, enabling it to be quickly detached for laundering and later re-attachment, or replacement. A cover which completely encloses the head with pad attached, shields against loss of emollients and permits hygienic storage and packing. Further, the head can be detached from the handle, so that the head, with pad and cover in place, can be stored and transported separate from the handle and grip. Handle and head are made of rigid plastics, the grip of vinyl, and the pad is designed for repeated hygienic hot water-soap washing, dryer cycles, and many re-uses. The dimensions of grip, handle, head and pad are economically selected for best results with maximum comfort and minimum operating cost. Unfortunately, this prior art example is not designed for traveling purposes and does not provide removable attachments for various personal needs.

Accordingly, the present invention is disclosed in order to overcome the above noted shortcomings. The present invention satisfies such a need providing a kit that is convenient and easy to use, lightweight yet durable in design, and assists a user to scratch, wash, and apply lotions to hard to reach areas of the body. The travel kit would allow consumers to simply and effectively scratch, wash, and apply lotions to areas of the body that can be difficult to access, whether at home or on the road. The travel kit would be especially beneficial for applying sun block because the extended handle would enable complete coverage of areas such as the back, behind the legs, and the feet, allowing sunbathers to be protected from burning. The present invention is simple to use, inexpensive, and designed for many years of repeated use.

BRIEF SUMMARY OF THE INVENTION

In view of the foregoing background, it is therefore an object of the present invention to provide an apparatus for assisting a user to scratch, wash, and apply lotions to hard to reach areas of the body. These and other objects, features, and advantages of the invention are provided by a travel kit.

A travel kit for assisting a user to scratch, wash, and apply lotions to hard to reach areas of the body includes a hollow shaft provided with telescopically interfitted rectilinear first, second, and third sections respectively. Such respective first, second, and third sections are telescopically compressible and extendible along a linear path. The first section conveniently has a diameter greater than a diameter of the second section and the diameter of the second section is greater than the diameter of the third section such that the third section snugly interfits within the second section while the second section simultaneously snugly interfits within the first section during operating conditions.

The second section is independently and selectively interfitted within the first section while the third section is independently and selectively interfitted within the second section. The first section is effectively provided with a durable and resilient material covering a major portion thereof. Such material is advantageously located adjacent to a proximal end of the first section and further terminates proximal to the bracket of the first section. Each of the first, second, and third sections have substantially equal longitudinal lengths respectively.

The kit further includes a rectilinear connector directly and statically attached to a distal tip of the third section. Such a connector conveniently has a longitudinal length registered parallel to a longitudinal length of the shaft. The connector has a diameter greater than a diameter of the third section and has axially opposed first and second ends respectively. The connector further has an aperture formed in a top surface thereof and is located adjacent to the first end of the connector. Such an aperture effectively has a longitudinal axis registered perpendicular to the longitudinal length of the connector. The second end of the connector advantageously has a groove monolithically formed in a bottom surface thereof. Such a groove removably receives and contains a selected one of the plurality of attachments therein during operating conditions.

The travel kit further includes a plurality of attachments connected directly to the connector and the distal tip of the third section respectively and a mechanism for removably connecting the connector and the plurality of attachments respectively to the distal tip of the third section. Such a removably connecting mechanism effectively includes a detent formed in the third section and located adjacent to the distal tip thereof. Such a detent conveniently penetrates outwardly from the aperture of the connector when the third section is interfitted within the first end of the connector such that the connector is prohibited from prematurely and undesirably disconnecting from the third section during operating conditions.

The travel kit further includes a mechanism for advantageously locking the hollow shaft between compressed and extended positions during operating conditions. Such a locking mechanism includes a plurality of depressions monolithically formed in inner surfaces of the first and second sections respectively. Such depressions terminate proximal to respective outer surfaces of the first and second sections such that the depressions do not penetrate through the outer surfaces of the first and second sections. Such depressions are equidistantly spaced along the longitudinal lengths of the first and second sections respectively. Each of the depressions are equidistantly offset from a centrally registered path defined by longitudinal lengths of the first and second sections respectively.

The locking mechanism further includes a plurality of depressions monolithically formed in the outer surfaces of the second and third sections respectively. Such depressions effectively terminate proximal to respective inner surfaces of the second and third sections such that the depressions do not penetrate through the inner surfaces of the second and third sections. The depressions are equidistantly spaced along the longitudinal lengths of the second and third sections respectively. Each of the depressions are equidistantly offset from the centrally registered path defined by the longitudinal lengths of the second and third sections respectively. The inner depressions and the outer depressions are conveniently juxtaposed along the longitudinal lengths respectively.

The locking mechanism further includes an arcuately shaped knob formed in the outer surface of the second and the third sections respectively. Such a knob is advantageously located adjacent to a proximal tip of the second and the third sections respectively and extends outwardly therefrom. The knob is shaped and sized to reside within an associated one of the inner depressions such that the shaft is prohibited from prematurely and undesirably compressing and extending during operating conditions.

The locking mechanism further included a plurality of cylindrical brackets directly attached to the outer surface of the first and second sections respectively and further encircling an entire circumference thereof. Each of the brackets effectively is located adjacent to a distal tip of the first and second sections respectively and further has a longitudinal length that is less than the longitudinal lengths of the first and second sections respectively such that the brackets terminate proximal to the proximal ends of the first and second sections respectively. Each of the brackets further has an arcuately shaped tab monolithically formed therewith and extending inwardly therefrom.

Such a tab is suitably shaped and sized to reside within an associated one of the outer depressions such that the shaft is prohibited from prematurely and undesirably compressing and extending along the associated longitudinal length during operating conditions. The tab of the bracket of the first section conveniently resides within an associated one of the outer depressions of the second section while the tab of the bracket of the second section resides within an associated one of the outer depressions of the third section.

A method for scratching, washing, and applying lotions to hard to reach areas of the body includes the step of providing a hollow shaft with telescopically interfitted rectilinear first, second, and third sections respectively. Such respective first, second, and third sections are telescopically compressible and extendible along a linear path. Each of the first, second, and third sections has substantially equal longitudinal lengths respectively.

The steps further include directly and statically attaching a rectilinear connector to a distal tip of the third section. Such a connector has a longitudinal length registered parallel to a longitudinal length of the shaft. The connector has a diameter greater than a diameter of the third section. The steps further include: directly connecting a plurality of attachments to the connector and the distal tip of the third section respectively; removably connecting the connector and the plurality of attachments respectively to the distal tip of the third section; and locking the hollow shaft between compressed and extended positions during operating conditions.

The method further includes these steps of: independently and selectively interfitting the second section within the first section; independently and selectively interfitting the third section within the second section; providing a detent formed in the third section and located adjacent to the distal tip thereof; and outwardly penetrating the detent from the aperture of the connector when the third section is interfitted within the first end of the connector such that the connector is prohibited from prematurely and undesirably disconnecting from the third section during operating conditions.

The method further includes the step of providing a plurality of depressions monolithically formed in inner surfaces of the first and second sections respectively. Such depressions terminate proximal to respective outer surfaces of the first and second sections such that the depressions do not penetrate through the outer surfaces of the first and second sections. The depressions are equidistantly spaced along the longitudinal lengths of the first and second sections respectively, and each of the depressions are equidistantly offset from a centrally registered path defined by longitudinal lengths of the first and second sections respectively.

The steps further include providing a plurality of depressions monolithically formed in the outer surfaces of the second and third sections respectively. Such depressions terminate proximal to respective inner surfaces of the second and third sections such that the depressions do not penetrate through the inner surfaces of the second and third sections. The depressions are equidistantly spaced along the longitudinal lengths of the second and third sections respectively, and each of the depressions is equidistantly offset from the centrally registered path defined by the longitudinal lengths of the second and third sections respectively. The inner depressions and the outer depressions are juxtaposed along the longitudinal lengths respectively.

The steps further include providing an arcuately shaped knob formed in the outer surface of the second and the third sections respectively. Such a knob is located adjacent to a proximal tip of the second and the third sections respectively and extending outwardly therefrom. The knob is shaped and sized to reside within an associated one of the inner depressions such that the shaft is prohibited from prematurely and undesirably compressing and extending during operating conditions.

The steps further include directly attaching a plurality of cylindrical brackets to the outer surface of the first and second sections respectively and further encircling an entire circumference thereof. Each of the brackets is located adjacent to a distal tip of the first and second sections respectively and further has a longitudinal length that is less than the longitudinal lengths of the first and second sections respectively such that the brackets terminate proximal to the proximal ends of the first and second sections respectively. Each of the brackets has an arcuately shaped tab monolithically formed therewith and extending inwardly therefrom.

The steps further include: positioning the tab within an associated one of the outer depressions such that the shaft is prohibited from prematurely and undesirably compressing and extending along the associated longitudinal length during operating conditions; positioning the tab of the bracket of the first section within an associated one of the outer depressions of the second section; and positioning the tab of the bracket of the second section within an associated one of the outer depressions of the third section.

The method finally includes the step of covering a major portion of the first section with a durable and resilient material. Such material is located adjacent to a proximal end of the first section and further terminating proximal to the bracket of the first section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
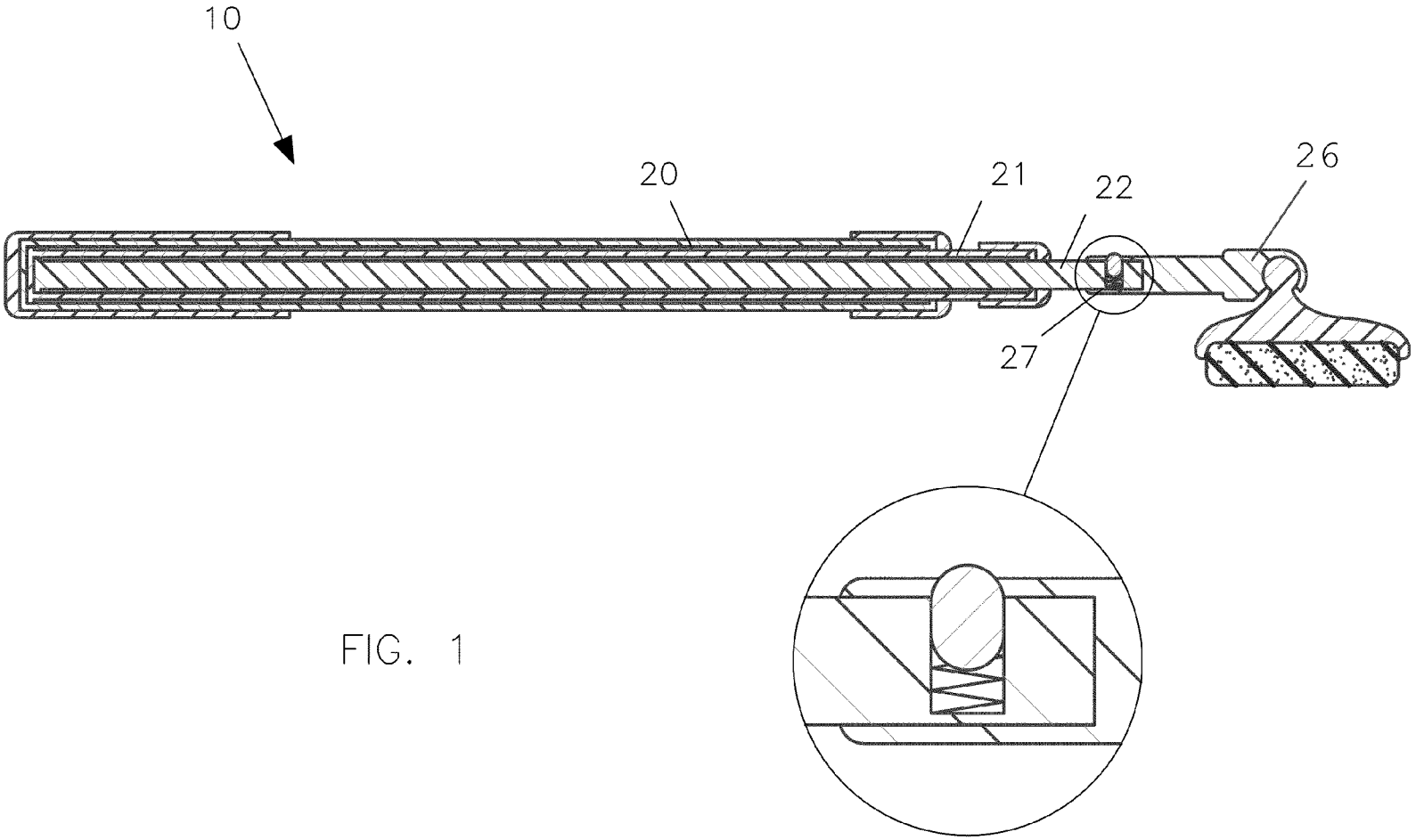
FIG. 1 is a side elevational view of the present invention, with an enlarged view of the connector, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-6 by the reference numeral 10 and is intended to provide a travel kit. It should be understood that the apparatus 10 may be used to apply many different types of substances to the body and should not be limited to applying only those substances mentioned herein.

Figure 2:
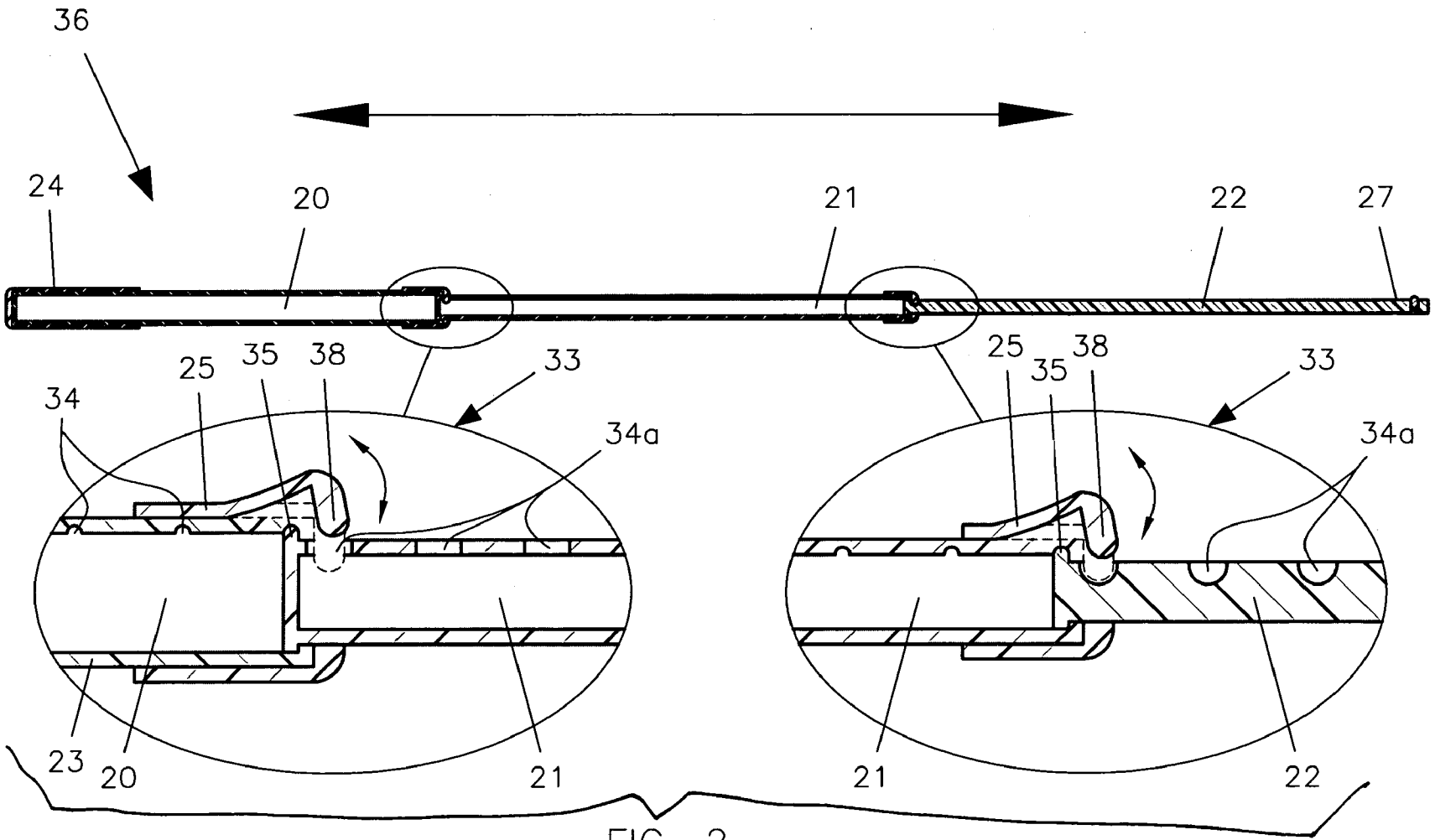
FIG. 2 is side elevational view of the shaft, in accordance with the present invention, with enlarged views of the locking mechanisms of the first and second sections, respectively.

Referring initially to FIGS. 1 and 2, a travel kit for assisting a user to scratch, wash, and apply lotions to hard to reach areas of the body includes a hollow shaft provided with telescopically interfitted rectilinear first, second, and third sections respectively. Such respective first 20, second 21, and third 22 sections are telescopically compressible and extendible along a linear path. The first section 20 conveniently has a diameter greater than a diameter of the second section 21 and the diameter of the second section is greater than the diameter of the third section 22 which is essential such that the third section 22 snugly interfits within the second section 21 while the second section simultaneously snugly interfits within the first section during operating conditions. The telescopically compressible sections allow a user to compress the kit, when needed, for easy traveling.

Referring again to FIGS. 1 and 2, the second section 21 is independently and selectively interfitted within the first section 20 while the third section 22 is independently and selectively interfitted within the second section 21. The first section is effectively provided with a durable and resilient material covering 23 a major portion thereof. Such material is advantageously located adjacent to a proximal end 24 of the first section 20 and further terminates proximal to the bracket 25 of the first section 20. Each of the first, second, and third sections have substantially equal longitudinal lengths respectively. The resilient material allows a user to use the apparatus in the shower without worrying about damage being caused to the kit.

Referring to FIG. 1, the kit further includes a rectilinear connector 26 directly and statically attached to a distal tip 27 of the third section 22. Such a connector 26 conveniently has a longitudinal length registered parallel to a longitudinal length of the shaft. The connector 26 has a diameter greater than a diameter of the third section 22 and has axially opposed first and second ends respectively. The connector 26 further has an aperture 28 formed in a top surface thereof and is located adjacent to the first end of the connector 26. Such an aperture 28 effectively has a longitudinal axis registered perpendicular to the longitudinal length of the connector 26. The second end of the connector 26 advantageously has a groove 29 monolithically formed in a bottom surface thereof. Such a groove 29 removably receives and contains a selected one of the plurality of attachments 30 therein during operating conditions. The connector allows a user to easily connect the appropriate attachment to the telescopic sections.

Figure 3:
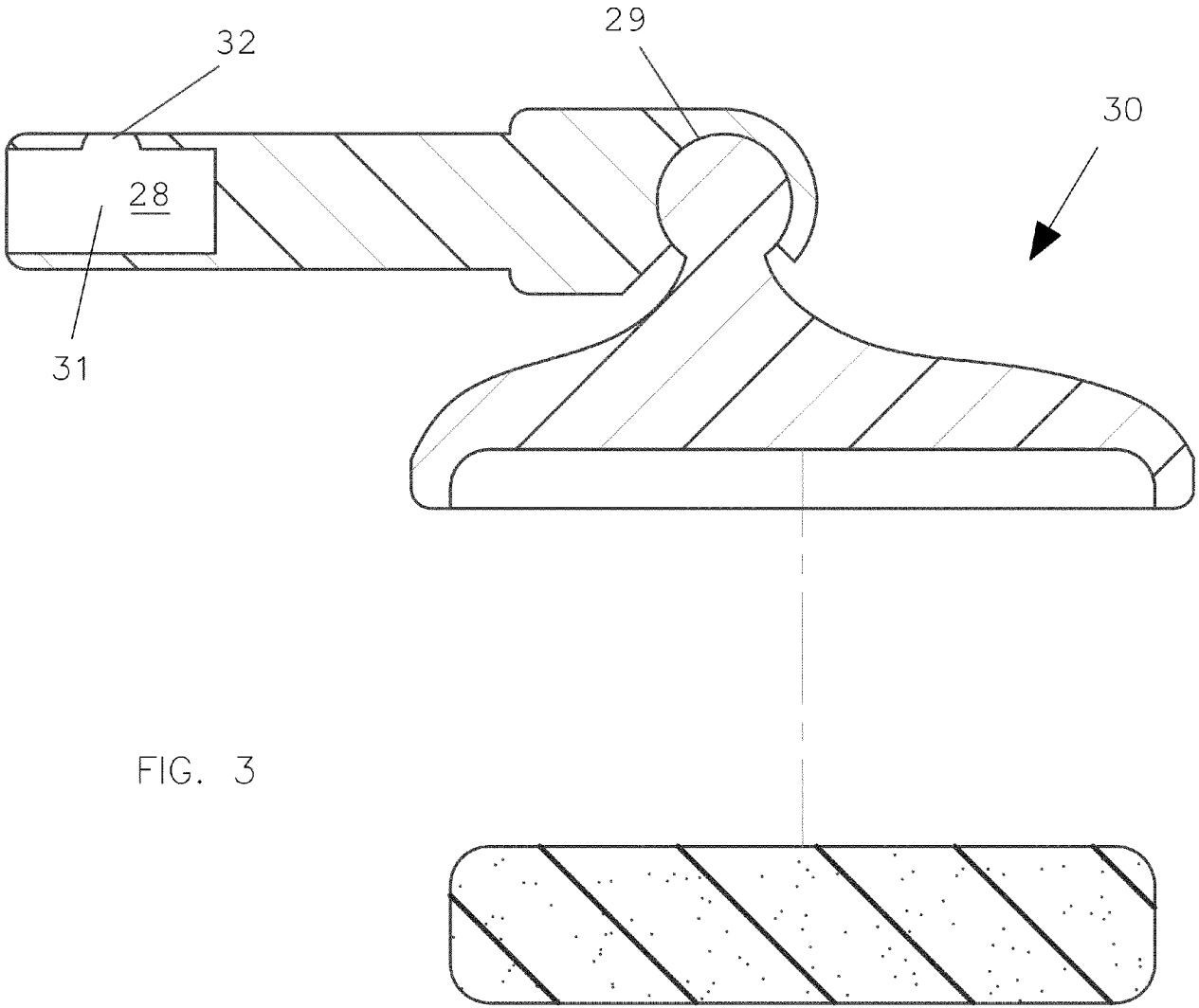
FIG. 3 is a side elevational view of one attachment of the present invention.
Figure 4:
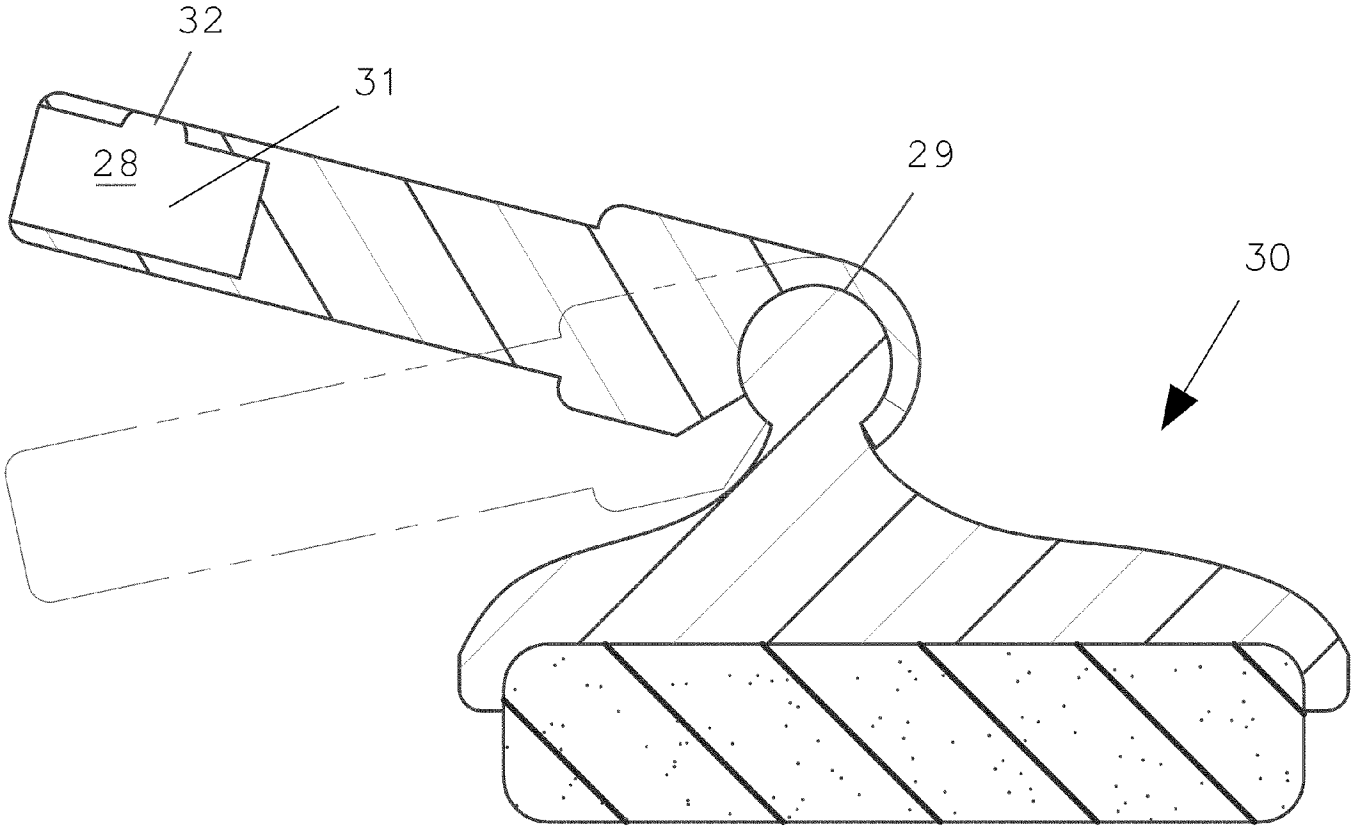
FIG. 4 is a side elevational view of the attachment shown in FIG. 3 in a rotational movement.
Figure 5:
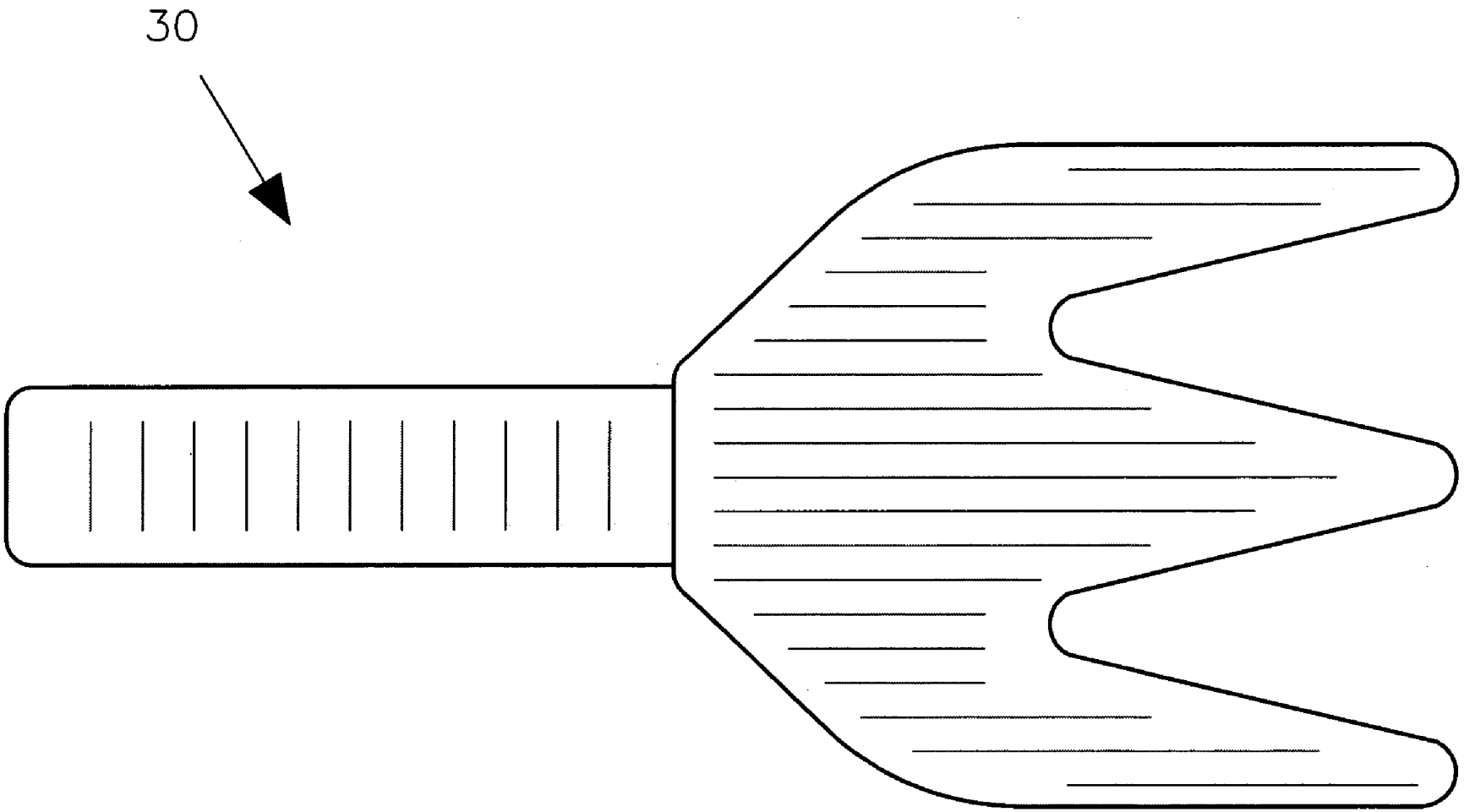
FIG. 5 is a top plan view of another attachment, in accordance with the present invention.
Figure 6:
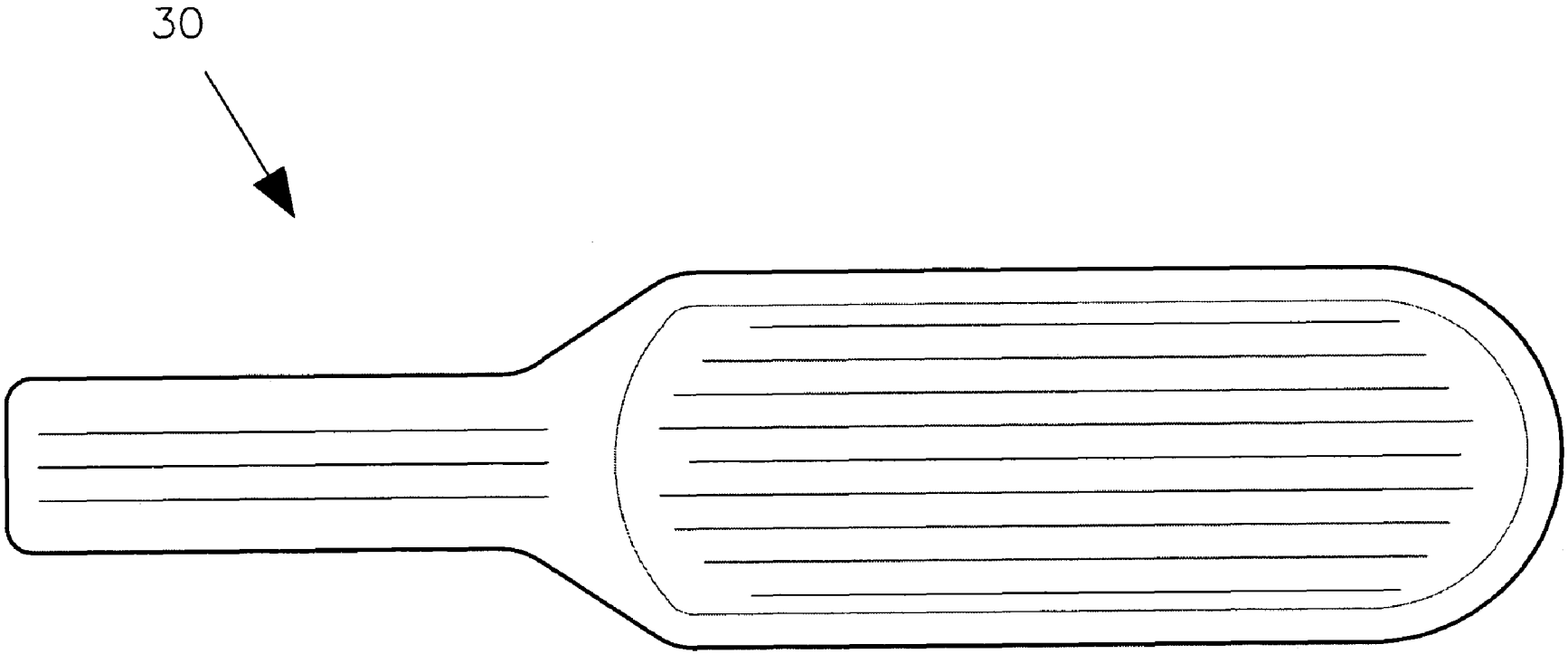
FIG. 6 is a top plan view of another attachment, in accordance with the present invention.
Figure 7:
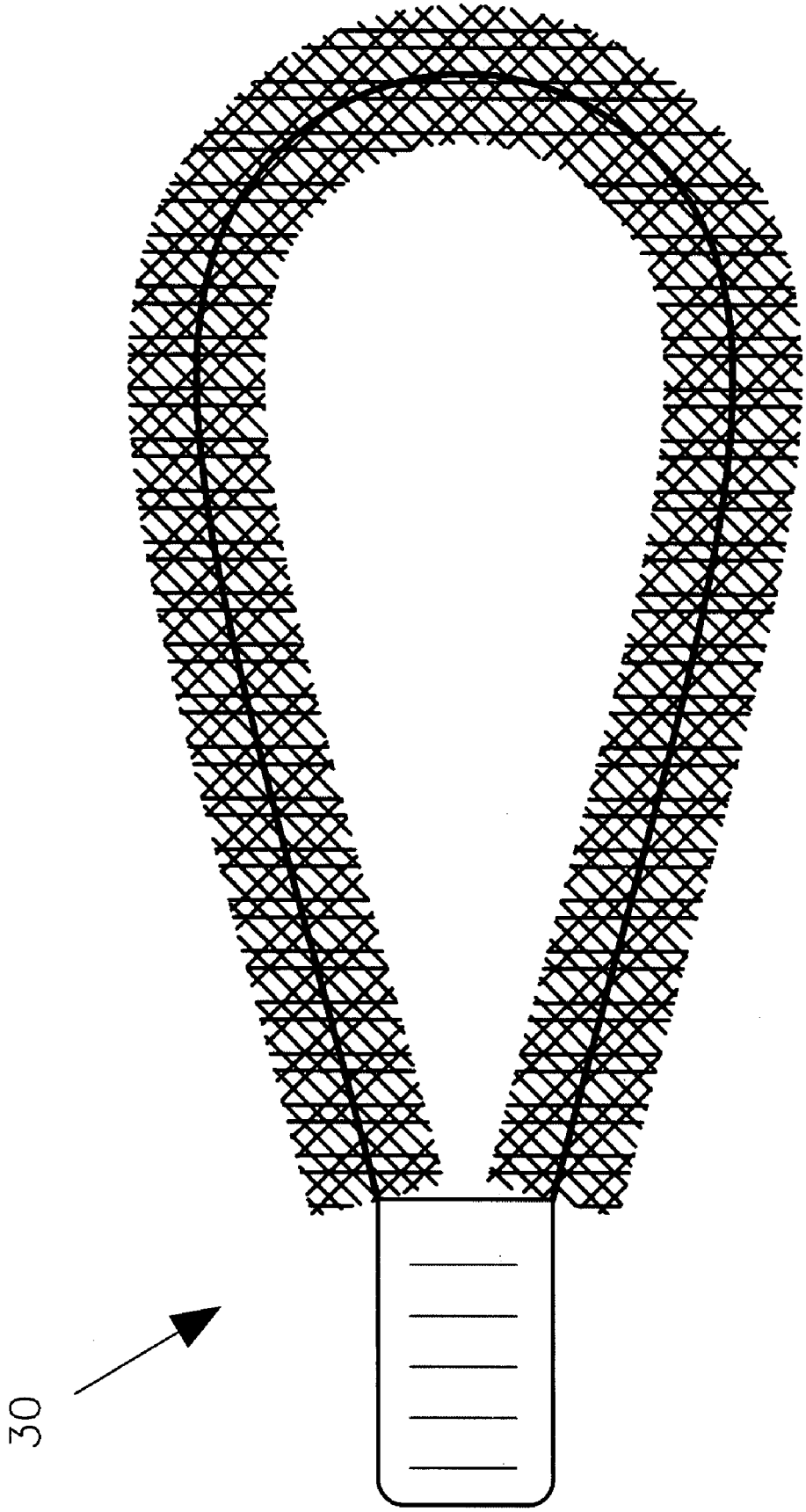
FIG. 7 is a top plan view of another attachment, in accordance with the present invention.

Referring to FIGS. 1, 3 and 4, the travel kit further includes a plurality of attachments 30 connected directly, without the use of intervening characters, to the connector 26 and the distal tip 27 of the third section 22 respectively and a mechanism for removably connecting the connector 26 and the plurality of attachments 30 respectively to the distal tip of the third section. Such a removably connecting mechanism 31 effectively includes a detent 32 formed in the third section 22 and located adjacent to the distal tip thereof. Such a detent 32 conveniently penetrates outwardly from the aperture 28 of the connector 26 when the third section 22 is interfitted within the first end of the connector 26 which is crucial such that the connector 26 is prohibited from prematurely and undesirably disconnecting from the third section 22 during operating conditions. The plurality of attachments 30 allows a user to perform a variety of personal grooming tasks with the use of only one kit.

Referring to FIG. 2, the travel kit further includes a mechanism for advantageously locking the hollow shaft between compressed and extended positions during operating conditions. Such a locking mechanism 33 includes a plurality of depressions 34 monolithically formed in inner surfaces of the first and second sections 20, 21 respectively. Such depressions 34 terminate proximal to respective outer surfaces of the first and second sections which is necessary such that the depressions 34 do not penetrate through the outer surfaces of the first and second sections. Such depressions 34 are equidistantly spaced along the longitudinal lengths of the first and second sections respectively. Each of the depressions 34 are equidistantly offset from a centrally registered path defined by longitudinal lengths of the first and second sections respectively. The locking mechanism ensures that the telescopic sections will remain in an extended position during use of the kit.

Referring again to FIG. 2, the locking mechanism 33 further includes a plurality of depressions 34*a* monolithically formed in the outer surfaces of the second and third sections respectively. Such depressions 34*a* effectively terminate proximal to respective inner surfaces of the second and third sections which is critical such that the depressions do not penetrate through the inner surfaces of the second and third sections. The depressions are equidistantly spaced along the longitudinal lengths of the second and third sections 21, 22 respectively. The depressions of the third section need not penetrate all the way through the section, due to the solid nature of the section. The depressions in the second section necessarily penetrate through the section due to the hollow nature of the section. Each of the depressions 34*a* is equidistantly offset from the centrally registered path defined by the longitudinal lengths of the second and third sections respectively. The inner depressions and the outer depressions 34, 34*a* are conveniently juxtaposed along the longitudinal lengths respectively.

Referring again to FIG. 2, the locking mechanism 33 further includes an arcuately shaped knob 35 formed in the outer surface of the second and the third sections 21, 22 respectively. Such a knob 35 is advantageously located adjacent to a proximal tip of the second and the third sections respectively and extends outwardly therefrom. The knob 35 is shaped and sized to reside within an associated one of the inner depressions 34 which is essential such that the shaft 36 is prohibited from prematurely and undesirably compressing and extending during operating conditions.

Referring again to FIG. 2, the locking mechanism 33 further included a plurality of cylindrical brackets 25 directly, without the use of intervening characters, attached to the outer surface of the first and second sections 20, 21 respectively and further encircling an entire circumference thereof. Each of the brackets 25 effectively is located adjacent to a distal tip of the first and second sections respectively and further has a longitudinal length that is less than the longitudinal lengths of the first and second sections respectively which is crucial such that the brackets 25 terminate proximal to the proximal ends of the first and second sections respectively. Each of the brackets 25 further has an arcuately shaped tab 38 monolithically formed therewith and extending inwardly therefrom.

Such a tab 38 is suitably shaped and sized to reside within an associated one of the outer depressions 34*a* which is essential such that the shaft 36 is prohibited from prematurely and undesirably compressing and extending along the associated longitudinal length during operating conditions. The tab 38 of the bracket 37 of the first section conveniently resides within an associated one of the outer depressions 34*a* of the second section 21 while the tab 38 of the bracket 37 of the second section 21 resides within an associated one of the outer depressions 34*a* of the third section 22. The tabs ensure that the bracket remains in place until a user is ready to depress the telescopic sections after use.

The telescopic sections provide a user the unexpected benefit of being able to reach hard to reach places on the body, even while traveling. The various attachments allow a user to perform many personal tasks on hard to reach places on the body. A user can apply lotion, scrub or scratch their back, or easily put on their shoes with a shoe horn, simply by changing to the appropriate attachment. Such benefits overcome the prior art shortcomings.

In use, a method for scratching, washing, and applying lotions to hard to reach areas of the body includes the step of providing a hollow shaft 36 with telescopically interfitted rectilinear first, second and third sections 20, 21, 22 respectively. Such respective first, second, and third sections are telescopically compressible and extendible along a linear path. Each of the first, second, and third sections has substantially equal longitudinal lengths respectively.

In use, the steps further include directly and statically attaching a rectilinear connector 26 to a distal tip of the third section 22. Such a connector 26 has a longitudinal length registered parallel to a longitudinal length of the shaft 36. The connector 26 has a diameter greater than a diameter of the third section 22. The steps further include: directly connecting a plurality of attachments 30 to the connector 26 and the distal tip 37 of the third section 22 respectively; removably connecting the connector 26 and the plurality of attachments 30 respectively to the distal tip 37 of the third section 22; and locking the hollow shaft 36 between compressed and extended positions during operating conditions.

In use, the method further includes these steps of: independently and selectively interfitting the second section 21 within the first section 20; independently and selectively interfitting the third section 22 within the second section 21; providing a detent formed in the third section 22 and located adjacent to the distal tip 37 thereof; and outwardly penetrating the detent 32 from the aperture 28 of the connector 26 when the third section 22 is interfitted within the first end of the connector 26 such that the connector 26 is prohibited from prematurely and undesirably disconnecting from the third section 22 during operating conditions.

In use, the method further includes the step of providing a plurality of depressions 34 monolithically formed in inner surfaces of the first and second sections 20, 21 respectively. Such depressions 34 terminate proximal to respective outer surfaces of the first and second sections such that the depressions 34 do not penetrate through the outer surfaces of the first and second sections 20, 21. The depressions 34 are equidistantly spaced along the longitudinal lengths of the first and second sections respectively, and each of the depressions 34 are equidistantly offset from a centrally registered path defined by longitudinal lengths of the first and second sections 20, 21 respectively.

In use, the steps further include providing a plurality of depressions 34*a* monolithically formed in the outer surfaces of the second and third sections 21, 22 respectively. Such depressions 34*a* terminate proximal to respective inner surfaces of the second and third sections 21, 22 such that the depressions 34*a* do not penetrate through the inner surfaces of the second and third sections. The depressions 34*a* are equidistantly spaced along the longitudinal lengths of the second and third sections 21, 22 respectively, and each of the depressions 34*a* is equidistantly offset from the centrally registered path defined by the longitudinal lengths of the second and third sections respectively. The inner depressions 34 and the outer depressions 34*a* are juxtaposed along the longitudinal lengths respectively.

In use, the steps further include providing an arcuately shaped knob 35 formed in the outer surface of the second and the third sections respectively. Such a knob 35 is located adjacent to a proximal tip of the second and the third sections respectively and extending outwardly therefrom. The knob 35 is shaped and sized to reside within an associated one of the inner depressions such that the shaft 36 is prohibited from prematurely and undesirably compressing and extending during operating conditions.

In use, the steps further include directly attaching a plurality of cylindrical brackets 25 to the outer surface of the first and second sections 20, 21 respectively and further encircling an entire circumference thereof. Each of the brackets 25 is located adjacent to a distal tip of the first and second sections respectively and further has a longitudinal length that is less than the longitudinal lengths of the first and second sections respectively such that the brackets 25 terminate proximal to the proximal ends of the first and second sections 20, 21 respectively. Each of the brackets has an arcuately shaped tab 38 monolithically formed therewith and extending inwardly therefrom.

In use, the steps further include: positioning the tab 38 within an associated one of the outer depressions 34*a* such that the shaft 36 is prohibited from prematurely and undesirably compressing and extending along the associated longitudinal length during operating conditions; positioning the tab 38 of the bracket of the first section within an associated one of the outer depressions of the second section; and positioning the tab 38 of the bracket 25 of the second section 21 within an associated one of the outer depressions 34*a* of the third section 22.

In use, the method finally includes the step of covering a major portion of the first section with a durable and resilient material 23. Such material is located adjacent to a proximal end of the first section and further terminating proximal to the bracket of the first section.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A travel kit for assisting a user to scratch, wash, and apply lotions to hard to reach areas of the body, said travel kit comprising:

a hollow shaft provided with telescopically interfitted rectilinear first, second, and third sections respectively, said respective first, second, and third sections being telescopically compressible and extendible along a linear path;

a rectilinear connector directly and statically attached to a distal tip of said third section, said connector having a longitudinal length registered parallel to a longitudinal length of said shaft, said connector having a diameter greater than a diameter of said third section;

a plurality of attachments connected directly to said connector and said distal tip of said third section respectively;

means for removably connecting said connector and said plurality of attachments respectively to said distal tip of said third section; and means for locking said hollow shaft between compressed and extended positions during operating conditions; wherein said connector has axially opposed first and second ends respectively, said connector having an aperture formed in a top surface thereof and further being located adjacent to said first end of said connector, said aperture having a longitudinal axis registered perpendicular to said longitudinal length of said connector, said second end of said connector having a groove monolithically formed in a bottom surface thereof, said groove for removably receiving and containing a selected one of said plurality of attachments therein during operating conditions.

2. The travel kit of claim 1, wherein said first section has a diameter greater than a diameter of said second section, said diameter of said second section being greater than said diameter of said third section such that said third section snugly interfits within said second section while said second section simultaneously snugly interfits within said first section during operating conditions.

3. The travel kit of claim 1, wherein said second section is independently and selectively interfitted within said first section while said third section is independently and selectively interfitted within said second section.

4. The travel kit of claim 3, wherein said removably connecting means comprises:

a detent formed in said third section and located adjacent to said distal tip thereof, said detent penetrating outwardly from said aperture of said connector when said third section is interfitted within said first end of said connector such that said connector is prohibited from prematurely and undesirably disconnecting from said third section during operating conditions.

5. The travel kit of claim 4, wherein said locking means comprises:

a plurality of first depressions monolithically formed in inner surfaces of said first and second sections respectively, a first group of said first depressions terminating proximal to respective outer surfaces of said first and second sections such that said first group of first depressions do not penetrate through said outer surfaces of said first and second sections, said first group of first depressions being equidistantly spaced along said longitudinal lengths of said first and second sections respectively, each of said first group of first depressions being equidistantly offset from a centrally registered path defined by longitudinal lengths of said first and second sections respectively, wherein a second group of said first depressions penetrate through said outer surface of said second section;

a plurality of second depressions monolithically formed in said outer surfaces of said second and third sections respectively, said second depressions terminating proximal to respective inner surfaces of said second and third sections such that said second depressions do not penetrate through said inner surfaces of said second and third sections, said second depressions being equidistantly spaced along said longitudinal lengths of said second and third sections respectively, each of said second depressions being equidistantly offset from said centrally registered path defined by said longitudinal lengths of said second and third sections respectively;

wherein said inner depressions and said outer depressions are juxtaposed along said longitudinal lengths respectively;

an arcuately shaped knob formed in said outer surface of said second and said third sections respectively, said knob being located adjacent to a proximal tip of said second and said third sections respectively and extending outwardly therefrom, said knob being shaped and sized to reside within an associated one of said inner depressions such that said shaft is prohibited from prematurely and undesirably compressing and extending during operating conditions; and a plurality of cylindrical brackets directly attached to said outer surface of said first and second sections respectively and further encircling an entire circumference thereof, each of said brackets being located adjacent to a distal tip of said first and second sections respectively and further having a longitudinal length that is less than said longitudinal lengths of said first and second sections respectively such that said brackets terminate proximal to said proximal ends of said first and second sections respectively, each of said brackets having an arcuately shaped tab monolithically formed therewith and extending inwardly therefrom, said tab being suitably shaped and sized to reside within an associated one of said outer depressions such that said shaft is prohibited from prematurely and undesirably compressing and extending along said associated longitudinal length during operating conditions;

wherein said tab of said bracket of said first section resides within an associated one of said outer depressions of said second section while said tab of said bracket of said second section resides within an associated one of said outer depressions of said third section.

6. The travel kit of claim 5, wherein said first section is provided with a durable and resilient material covering a major portion thereof, said material being located adjacent to a proximal end of said first section and further terminating proximal to said bracket of said first section.

7. A travel kit for assisting a user to scratch, wash, and apply lotions to hard to reach areas of the body, said travel kit comprising:

a hollow shaft provided with telescopically interfitted rectilinear first, second, and third sections respectively, said respective first, second, and third sections being telescopically compressible and extendible along a linear path;

wherein each of said first, second, and third sections have substantially equal longitudinal lengths respectively;

a rectilinear connector directly and statically attached to a distal tip of said third section, said connector having a longitudinal length registered parallel to a longitudinal length of said shaft, said connector having a diameter greater than a diameter of said third section;

a plurality of attachments connected directly to said connector and said distal tip of said third section respectively;

means for removably connecting said connector and said plurality of attachments respectively to said distal tip of said third section; and means for locking said hollow shaft between compressed and extended positions during operating conditions; wherein said connector has axially opposed first and second ends respectively, said connector having an aperture formed in a top surface thereof and further being located adjacent to said first end of said connector, said aperture having a longitudinal axis registered perpendicular to said longitudinal length of said connector, said second end of said connector having a groove monolithically formed in a bottom surface thereof, said groove for removably receiving and containing a selected one of said plurality of attachments therein during operating conditions.

8. The travel kit of claim 7, wherein said first section has a diameter greater than a diameter of said second section, said diameter of said second section being greater than said diameter of said third section such that said third section snugly interfits within said second section while said second section simultaneously snugly interfits within said first section during operating conditions.

9. The travel kit of claim 8, wherein said second section is independently and selectively interfitted within said first section while said third section is independently and selectively interfitted within said second section.

10. The travel kit of claim 9, wherein said removably connecting means comprises:

a detent formed in said third section and located adjacent to said distal tip thereof, said detent penetrating outwardly from said aperture of said connector when said third section is interfitted within said first end of said connector such that said connector is prohibited from prematurely and undesirably disconnecting from said third section during operating conditions.

11. The travel kit of claim 10, wherein said locking means comprises:

a plurality of first depressions monolithically formed in inner surfaces of said first and second sections respectively, a first group of said first depressions terminating proximal to respective outer surfaces of said first and second sections such that said first group of first depressions do not penetrate through said outer surfaces of said first and second sections, said first group of first depressions being equidistantly spaced along said longitudinal lengths of said first and second sections respectively, each of said first group of first depressions being equidistantly offset from a centrally registered path defined by longitudinal lengths of said first and second sections respectively, wherein a second group of said first depressions penetrate through said outer surface of said second section;

a plurality of second depressions monolithically formed in said outer surfaces of said second and third sections respectively, said second depressions terminating proximal to respective inner surfaces of said second and third sections such that said second depressions do not penetrate through said inner surfaces of said second and third sections, said second depressions being equidistantly spaced along said longitudinal lengths of said second and third sections respectively, each of said second depressions being equidistantly offset from said centrally registered path defined by said longitudinal lengths of said second and third sections respectively;

wherein said inner depressions and said outer depressions are juxtaposed along said longitudinal lengths respectively;

an arcuately shaped knob formed in said outer surface of said second and said third sections respectively, said knob being located adjacent to a proximal tip of said second and said third sections respectively and extending outwardly therefrom, said knob being shaped and sized to reside within an associated one of said inner depressions such that said shaft is prohibited from prematurely and undesirably compressing and extending during operating conditions; and a plurality of cylindrical brackets directly attached to said outer surface of said first and second sections respectively and further encircling an entire circumference thereof, each of said brackets being located adjacent to a distal tip of said first and second sections respectively and further having a longitudinal length that is less than said longitudinal lengths of said first and second sections respectively such that said brackets terminate proximal to said proximal ends of said first and second sections respectively, each of said brackets having an arcuately shaped tab monolithically formed therewith and extending inwardly therefrom, said tab being suitably shaped and sized to reside within an associated one of said outer depressions such that said shaft is prohibited from prematurely and undesirably compressing and extending along said associated longitudinal length during operating conditions;

wherein said tab of said bracket of said first section resides within an associated one of said outer depressions of said second section while said tab of said bracket of said second section resides within an associated one of said outer depressions of said third section.

12. The travel kit of claim 11, wherein said first section is provided with a durable and resilient material covering a major portion thereof, said material being located adjacent to a proximal end of said first section and further terminating proximal to said bracket of said first section.

13. A method for scratching, washing, and applying lotions to hard to reach areas of the body, said method comprising the steps of:

a. providing a hollow shaft having telescopically interfitted rectilinear first, second, and third sections respectively, said respective first, second, and third sections being telescopically compressible and extendible along a linear path, each of said first, second, and third sections having substantially equal longitudinal lengths respectively;

b. directly and statically attaching a rectilinear connector to a distal tip of said third section, said connector having a longitudinal length registered parallel to a longitudinal length of said shaft, said connector having a diameter greater than a diameter of said third section;

c. directly connecting a plurality of attachments to said connector and said distal tip of said third section respectively;

d. removably connecting said connector and said plurality of attachments respectively to said distal tip of said third section; and e. locking said hollow shaft between compressed and extended positions during operating conditions; wherein said connector has axially opposed first and second ends respectively, said connector having an aperture formed in a top surface thereof and further being located adjacent to said first end of said connector, said aperture having a longitudinal axis registered perpendicular to said longitudinal length of said connector, said second end of said connector having a groove monolithically formed in a bottom surface thereof, said groove for removably receiving and containing a selected one of said plurality of attachments therein during operating conditions.

14. The method of claim 13, wherein step e. comprises the steps of:

i. independently and selectively interfitting said second section within said first section; and ii. independently and selectively interfitting said third section within said second section.

15. The method of claim 13, wherein step d. further comprises the steps of:

i. providing a detent formed in said third section and located adjacent to said distal tip thereof; and ii. outwardly penetrating said detent from said aperture of said connector when said third section is interfitted within said first end of said connector such that said connector is prohibited from prematurely and undesirably disconnecting from said third section during operating conditions.

16. The method of claim 13, wherein step e. further comprises the steps of:

i. providing a plurality of first depressions monolithically formed in inner surfaces of said first and second sections respectively, a first group of said first depressions terminating proximal to respective outer surfaces of said first and second sections such that said first group of first depressions do not penetrate through said outer surfaces of said first and second sections, said first group of first depressions being equidistantly spaced along said longitudinal lengths of said first and second sections respectively, each of said first group of first depressions being equidistantly offset from a centrally registered path defined by longitudinal lengths of said first and second sections respectively, wherein a second group of said first depressions penetrate through said outer surface of said second section;

ii. providing a plurality of second depressions monolithically formed in said outer surfaces of said second and third sections respectively, said second depressions terminating proximal to respective inner surfaces of said second and third sections such that said second depressions do not penetrate through said inner surfaces of said second and third sections, said second depressions being equidistantly spaced along said longitudinal lengths of said second and third sections respectively, each of said second depressions being equidistantly offset from said centrally registered path defined by said longitudinal lengths of said second and third sections respectively, wherein said inner depressions and said outer depressions are juxtaposed along said longitudinal lengths respectively;

iii. providing an arcuately shaped knob formed in said outer surface of said second and said third sections respectively, said knob being located adjacent to a proximal tip of said second and said third sections respectively and extending outwardly therefrom, said knob being shaped and sized to reside within an associated one of said inner depressions such that said shaft is prohibited from prematurely and undesirably compressing and extending during operating conditions;

iv. directly attaching a plurality of cylindrical brackets to said outer surface of said first and second sections respectively and further encircling an entire circumference thereof, each of said brackets being located adjacent to a distal tip of said first and second sections respectively and further having a longitudinal length that is less than said longitudinal lengths of said first and second sections respectively such that said brackets terminate proximal to said proximal ends of said first and second sections respectively, each of said brackets having an arcuately shaped tab monolithically formed therewith and extending inwardly therefrom;

v. positioning said tab within an associated one of said outer depressions such that said shaft is prohibited from prematurely and undesirably compressing and extending along said associated longitudinal length during operating conditions;

vi. positioning said tab of said bracket of said first section within an associated one of said outer depressions of said second section; and vii. positioning said tab of said bracket of said second section within an associated one of said outer depressions of said third section.

17. The method of claim 13, further comprising the steps of:

a. covering a major portion of said first section with a durable and resilient material, said material being located adjacent to a proximal end of said first section and further terminating proximal to said bracket of said first section.

* * * * *